US008107874B2

(12) United States Patent
Yoon

(10) Patent No.: US 8,107,874 B2
(45) Date of Patent: Jan. 31, 2012

(54) PRINTING MEDIUM GUIDE DEVICE INCLUDING ROLLERS

(75) Inventor: Kwon Ho Yoon, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 904 days.

(21) Appl. No.: 12/026,737

(22) Filed: Feb. 6, 2008

(65) Prior Publication Data

US 2008/0298874 A1 Dec. 4, 2008

(30) Foreign Application Priority Data

Jun. 4, 2007 (KR) ..... 10-2007-0054429

(51) Int. Cl.
*B65H 29/58* (2006.01)
*B65H 29/60* (2006.01)
*B65H 85/00* (2006.01)

(52) U.S. Cl. ..... 399/401; 271/291; 271/301; 271/303

(58) Field of Classification Search ..... 399/401, 399/402; 271/301, 303, 291
See application file for complete search history.

(56) References Cited

U.S. PATENT DOCUMENTS

| | | | | |
|---|---|---|---|---|
| 5,028,046 | A * | 7/1991 | Kuwahara | 271/301 |
| 6,059,280 | A * | 5/2000 | Yamauchi et al. | 271/109 |
| 6,764,236 | B2 * | 7/2004 | Suzuki | 400/642 |
| 2001/0051011 | A1 * | 12/2001 | Takahashi et al. | 384/574 |
| 2002/0061215 | A1 * | 5/2002 | Kamei | 399/401 |
| 2005/0035540 | A1 * | 2/2005 | Carter et al. | 271/303 |

FOREIGN PATENT DOCUMENTS

| | | | |
|---|---|---|---|
| CN | 1851563 | | 10/2006 |
| JP | 05-077996 | | 3/1993 |
| JP | 05278918 | A * | 10/1993 |
| JP | 08-217293 | | 8/1996 |
| JP | 10-186882 | | 7/1998 |
| JP | 10181977 | A * | 7/1998 |
| JP | 2001158559 | A * | 6/2001 |
| JP | 2004331387 | A * | 11/2004 |
| JP | 2005041635 | A * | 2/2005 |
| JP | 2006027746 | A * | 2/2006 |
| KR | 2007-25051 | | 3/2007 |

OTHER PUBLICATIONS

Chinese Office Action issued Aug. 28, 2009 in CN Application No. 200810080836.1.

* cited by examiner

*Primary Examiner* — Daniel J Colilla
(74) *Attorney, Agent, or Firm* — Stanzione & Kim, LLP

(57) ABSTRACT

An image forming apparatus capable of guiding a printing medium in a smooth manner by minimizing resistance to the printing medium feed and preventing a developer from adhering and accumulating on a printing medium guide device. The image forming apparatus includes a printing medium guide device to guide a printing medium in a print path to a discharge path or guide the printing medium in the discharge path to a reverse path, and the printing medium guide device includes rollers to rotate by contacting the printing medium.

10 Claims, 5 Drawing Sheets

PRINTING MEDIUM GUIDE DEVICE INCLUDING ROLLERS

CROSS-REFERENCE TO RELATED APPLICATIONS

This application claims priority under 35 U.S.C. §119(a) from Korean Patent Application No. 2007-0054429, filed on Jun. 4, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus which includes a printing medium guide device to guide a printing medium toward a discharge path or a reverse path in a duplex printing operation.

2. Description of the Related Art

The image forming apparatuses, such as laser printers or copying machines, include a duplex image forming apparatus. The duplex image forming apparatus can print an image on both surfaces of a sheet of paper. Korean Patent Laid-open Publication No. 2007-0025051 relates to a conventional duplex image forming apparatus, which includes a print path to print the fed paper, a discharge path to discharge the printed paper, and a reverse path to turn over the paper, of which one surface has been printed, and feed the same again to the print path.

The conventional duplex image forming apparatus further includes a paper guide device which guides the paper, which has passed through a fusing unit in the print path, toward the discharge path, or guides the paper in the discharge path toward the reverse path in a duplex printing operation. The paper guide device is rotatably mounted in a junction point of the print path, the discharge path and the reverse path to convert the paper feeding path, and thus prevents a paper feeding error.

However, in the conventional image forming apparatus as structured above, because the paper guide device contacts a surface of the paper while guiding the paper feed, the paper guide device acts as a resistance to the paper feed, and a developer on the paper adheres to the paper guide device. Specifically, in the duplex printing operation, when the paper of which one surface has been printed passes again through the fusing unit, the developer fused to the previously-printed surface melts temporarily by heat while passing through the fusing unit, and adheres to the paper guide device. Then, the developer sticks to the paper guide device, and can continue to grow corresponding to the repetition of the printing, thereby interrupting the paper being feed in a smooth manner. For instance, the developer sticking to the paper guide device causes a scratch on the surface of the paper or paper jam.

SUMMARY OF THE INVENTION

The present general inventive concept provides an image forming apparatus that is equipped with a printing medium guide device capable of guiding the printing medium in a smooth manner by minimizing resistance to a feeding of the printing medium.

The present general inventive concept also provides an image forming apparatus that can prevent a developer from adhering and accumulating on a printing medium guide device.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including a printing medium guide device to guide a printing medium in a print path to a discharge path or guide the printing medium in the discharge path to a reverse path, wherein the printing medium guide device includes rollers to rotate by contacting the printing medium.

The printing medium guide device may further include a supporting shaft rotatably mounted near an outlet of the print path, and at least one printing medium guide portion which extends from the supporting shaft to rotate on the supporting shaft.

The printing medium guide portion may be provided in plural numbers and spaced apart from each other, the plural printing medium guide portions having ends directed toward the discharge path to mount the rollers thereon.

The printing medium guide device guides the printing medium to the discharge path by the printing medium guide portions being lifted up by the printing medium rising from the print path, and guides the printing medium in the discharge path to the reverse path by the printing medium guide portions descending by a respective weight thereof when the printing medium completely passes by the printing medium guide portions.

Each of the plural printing medium guide portions may have a roller receiving portion to receive a portion of a respective roller, a pair of roller supporting shafts provided on two opposite inner surfaces of the roller receiving portion to support the respective roller, and a cutting portion formed lengthwise in a longitudinal direction to mount the respective roller to the roller supporting shafts.

The printing medium guide device may further include an actuating portion which extends from the supporting shaft so that a rotational position of the printing medium guide portion can be detected by a sensor.

The printing medium guide device may further include a rotation limit protrusion provided on the actuating portion, and a rotation limit slot provided at a supporting plate supporting the supporting shaft and in which the rotation limit protrusion is disposed, and to limit a rotational range of the printing medium guide device to a predetermined range.

The foregoing and/or other aspects and utilities of the general inventive concept may also be achieved by providing a printing medium guide device usable with an image forming apparatus having a discharge path and a reverse path, the printing medium guide device including at least one guide portion having one or more rollers, and movable between a discharge position to guide a printing medium to the discharge path and a reverse position to guide the printing medium to the reverse path, wherein the at least one guide portion moves to one of the discharge position and the reverse position by a contact force of the printing medium and moves to an other of the discharge position and the reverse position by a respective weight of the guide portion.

The guide portion may move to the discharge position by the contact force of the printing medium and may move to the reverse position by the respective weight of the guide portion.

The at least one guide portion may include a curved portion to guide the printing medium toward the discharge path.

The printing medium guide device may also include a supporting shaft having a central axis and ends rotatably coupled to the image forming apparatus, wherein a plurality of the guide portions are attached to the supporting shaft and arranged in a longitudinal direction thereof with a predetermined gap therebetween.

The foregoing and/or other aspects and utilities of the general inventive concept may also be achieved by providing an image forming apparatus including a print path to direct a printing medium to be printed thereon, a reverse path to direct the printing medium to reverse a side thereof to be printed thereon and a discharge path to direct the printing medium to be discharged from the image forming apparatus, and a printing medium guide device disposed at a junction of the print path, the reverse path and the discharge path, the printing medium guide device including at least one guide portion having one or more rollers, and movable between a discharge position to guide the printing medium to the discharge path and a reverse position to guide the printing medium to the reverse path, wherein the at least one guide portion moves to one of the discharge position and the reverse position by a contact force of the printing medium and moves to an other of the discharge position and the reverse position by a respective weight of the guide portion.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
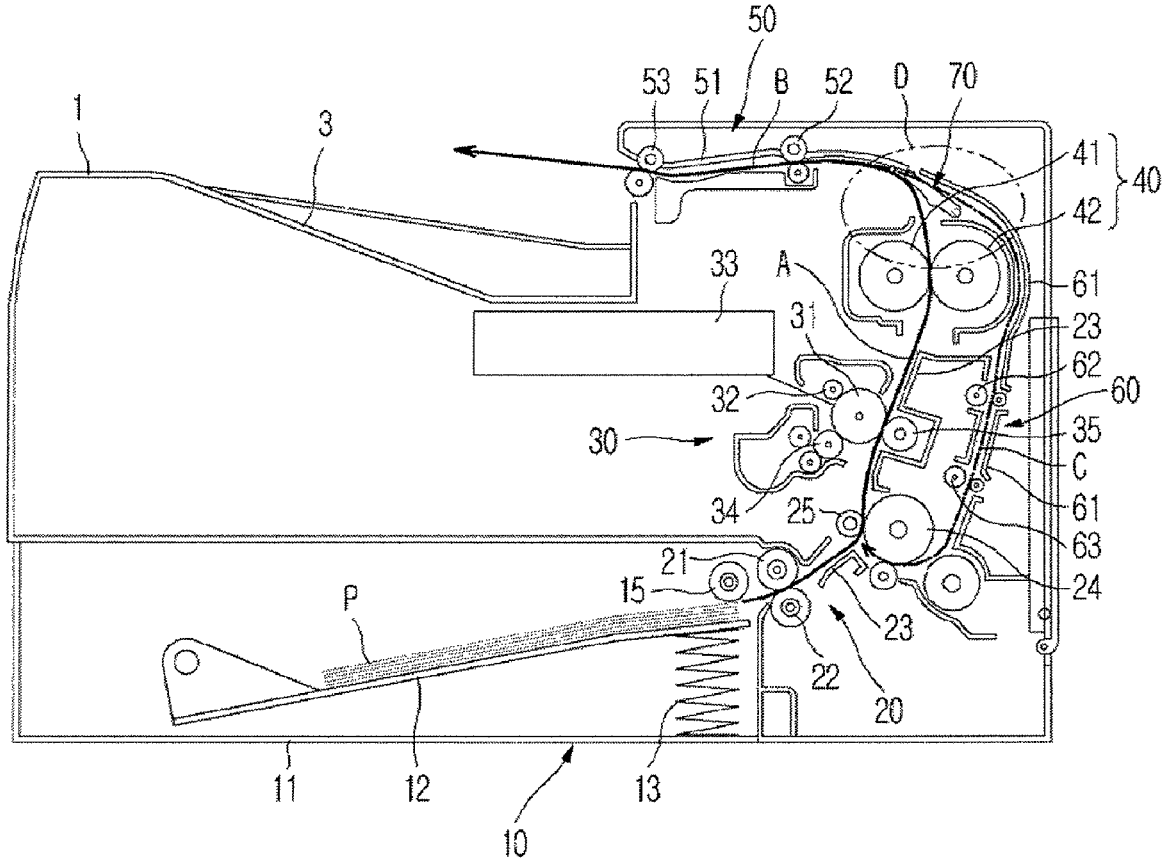
FIG. 1 is a sectional view illustrating a schematic constitution of an image forming apparatus in accordance with an embodiment of the present general inventive concept.

Reference will now be made in detail to embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating a schematic constitution of an embodiment of an image forming apparatus in accordance with the present general inventive concept. An image forming apparatus illustrated in FIG. 1 is a laser printer to print an image on a printing medium P such as paper. The image forming apparatus includes a printing medium supply unit 10 to accommodate a printing medium P to be printed thereon, a feed unit 20 to feed the printing medium P, an image forming unit 30 to form an image on the printing medium P, a fusing unit 40 to fuse the image transferred onto the printing medium P, a discharge unit 50 to discharge the printing medium P, and a reverse unit 60 to feed the printing medium in a reverse direction, of which one surface (e.g., a front surface) has been printed, to the image forming unit 30.

The printing medium supply unit 10 is mounted in a lower portion of a main body 1. The printing medium supply unit 10 includes a cassette-type printing medium tray 11, a press plate 12 and a press spring 13 to press the printing medium P in the printing medium tray 11 to a pickup roller 15 disposed over the press plate 12. The press spring 13 is mounted under the press plate 12, and biases the press plate 12 toward the pickup roller 15 so that the printing medium P loaded on the press plate 12 comes into contact with the pickup roller 15. The pickup roller 15 picks up the printing medium, for example, sheet by sheet, by a rotational force thereof, and supplies the printing medium to the feed unit 20.

The feed unit 20 feeds the printing medium picked up by the pickup roller 15 to a print path A. The feed unit 20 includes a feed roller 21, a feed backup roller 22, a feed guide 23 to form the print path A, a register roller 24 to register a front end of the fed printing medium, and a register backup roller 25.

The image forming unit 30 is mounted in the print path A above the register roller 24. The image forming unit 30 includes a photosensitive drum 31, a charge roller 32 to charge the photosensitive drum 31, a laser scanning unit (LSU) 33 to irradiate a laser beam to the charged photosensitive drum 31 according to an image signal to form an electrostatic latent image on a surface of the photosensitive drum 31, a developing roller 34 to supply a developer to the electrostatic latent image formed on the photosensitive drum 31 to form a visible image, and a transfer roller 35 to transfer the visible image formed on the photosensitive drum 31 onto the printing medium. The photosensitive drum 31 charged by the charge roller 32 has a negative charge, and the electrostatic latent image is formed on a surface of the photosensitive drum 31 by the laser beam irradiated from the LSU 33. The developing roller 34 supplies the developer having a negative charge to the electrostatic latent image on the photosensitive drum 31 to form the visible image. The transfer roller 35 having a positive charge transfers the developer adhering to the electrostatic latent image on the photosensitive drum 31 onto the printing medium, so that the visible image is formed on the printing medium.

The fusing unit 40 is disposed proximate to an outlet of the print path A above the image forming unit 30. The fusing unit 40 includes a heat roller 41 and a press roller 42. While the printing medium passes between the heat roller 41 and the press roller 42, the fusing unit 40 applies heat and pressure to the developer (image) transferred onto the printing medium so that the developer is fused onto the printing medium.

The discharge unit 50 feeds the printing medium, which has been printed while passing through the print path A, to a discharge portion 3 provided on an upper portion of the main body 1. The discharge unit 50 includes a discharge guide 51 to form a discharge path B, and discharge rollers 52 and 53 which are disposed in the discharge path B. The discharge rollers 52 and 53 can rotate in a forward direction to discharge the printing medium to the discharge portion 3, or can rotate in a reverse direction to feed the printing medium, which has passed through the fusing unit 40, to a reverse path C (which will be described later).

The reverse unit 60 feeds the printing medium in a reverse direction located in the discharge path B (the printing medium of which one surface has been printed) to the image forming unit 30 for the duplex printing. The reverse unit 60 includes a reverse guide 61 to form the reverse path C, and reverse rollers 62 and 63 which are mounted in the reverse path C. The reverse guide 61 connects an inlet of the reverse path C with the discharge path B, and connects an outlet of the reverse path C with the register roller 24 in the print path A. By the reverse rotation of the discharge rollers 52 and 53, the printing medium located in the discharge path B is fed to the print path A via the reverse path C. At this time, the printing medium advancing into the print path A is turned over while passing through the reverse path C. Accordingly, an image can be printed on another surface (e.g., a rear surface) of the printing medium.

The image forming apparatus can also include a printing medium guide device 70 which is mounted at a junction point of the paths, at which the outlet of the print path A, the inlet of the discharge path B and the inlet of the reverse path C join. The printing medium guide device 70 can guide the printing medium, which has passed through the print path A, to the discharge path B, and/or can guide the printing medium in the discharge path B to the reverse path C. When the printing medium located in the discharge path B is fed toward the reverse path C for the duplex printing, the printing medium guide device 70 guides the printing medium to advance into the reverse path C, thereby preventing a printing medium feed error.

Figure 4:
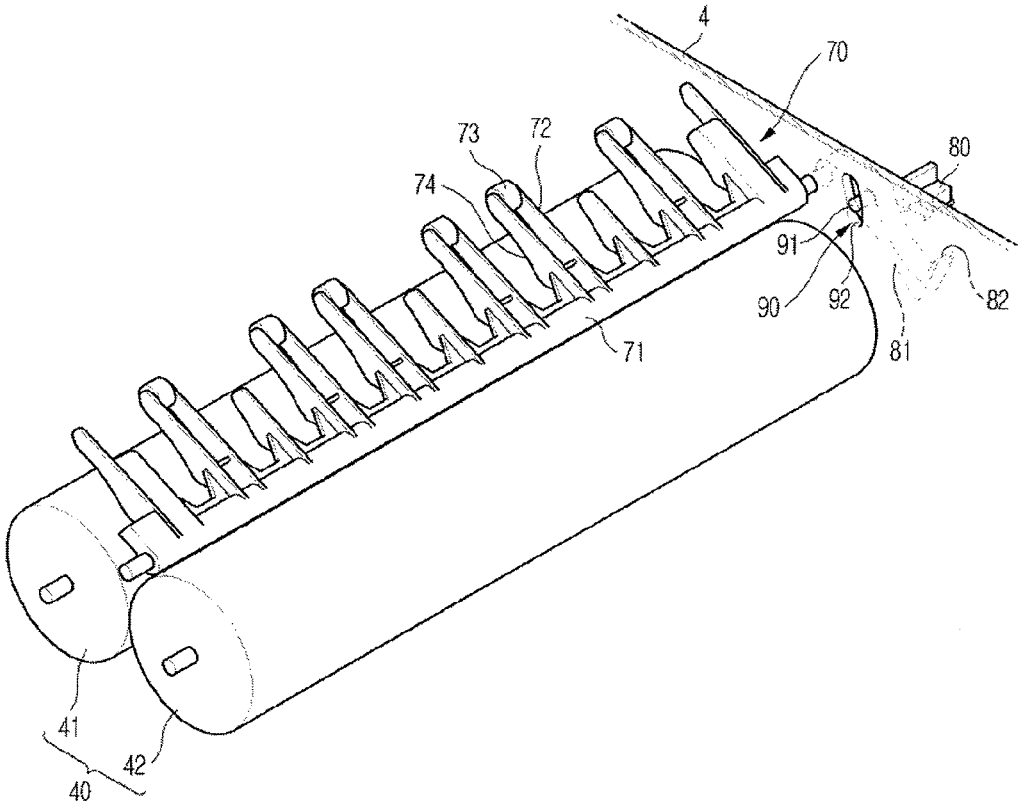
FIG. 4 is a perspective view illustrating an embodiment of the printing medium guide device depicted in FIG. 1.

As illustrated in FIG. 4, the printing medium guide device 70 includes a supporting shaft 71 which is rotatably mounted proximate to and/or on the press roller 42 of the fusing unit 40, a plurality of printing medium guide portions 72 which extend from the supporting shaft 71 by a predetermined length in a direction substantially parallel to the discharge path B, and rollers 73 which are mounted to the printing medium guide portions 72.

The supporting shaft 71 is arranged such that a central axis of the supporting shaft 71 is in parallel with a central axis of the press roller 42. Both ends of the supporting shaft 71 are rotatably coupled to supporting plates 4 which are provided on both upper sides of the main body 1. A plurality of printing medium guide portions 72 are arranged in a longitudinal direction of the supporting shaft 71 with a predetermined gap therebetween, and the rollers 73 are rotatably coupled to ends of the respective printing medium guide portions 72.

Figure 2:
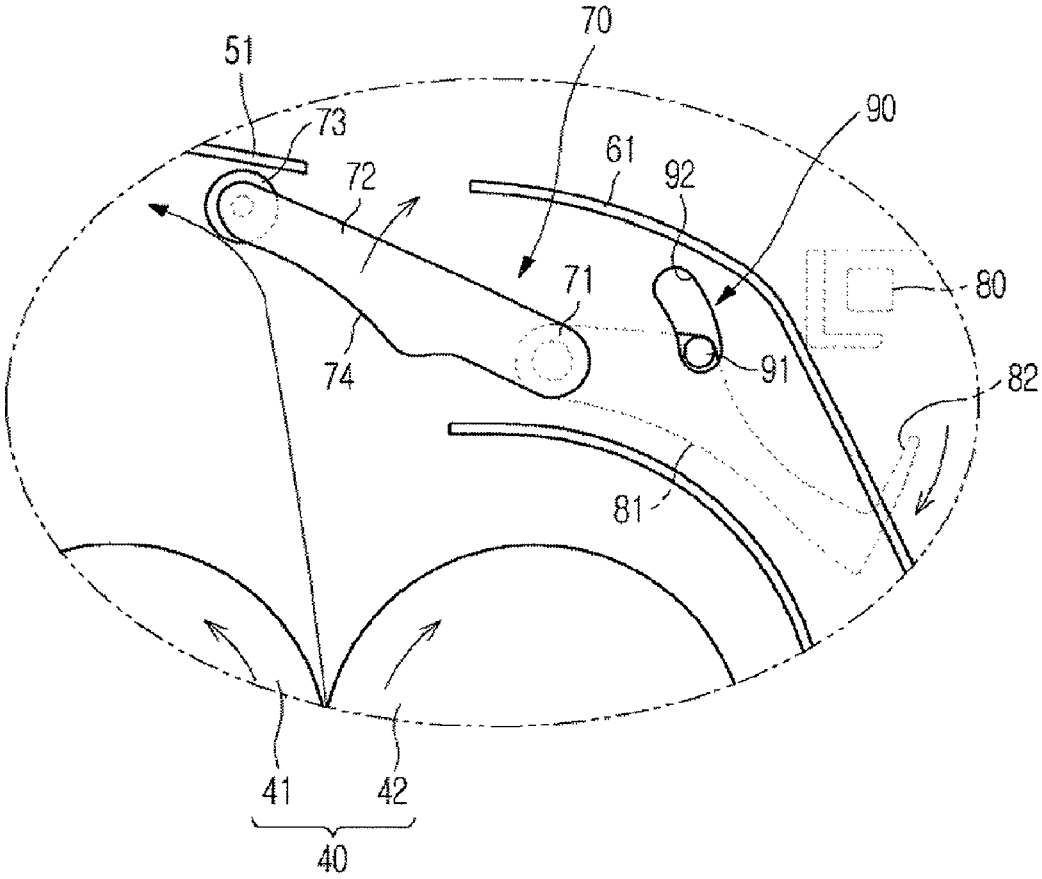
FIG. 2 is a detailed view of a "D" portion in FIG. 1, when a printing medium guide device is in an ascending state.
Figure 3:
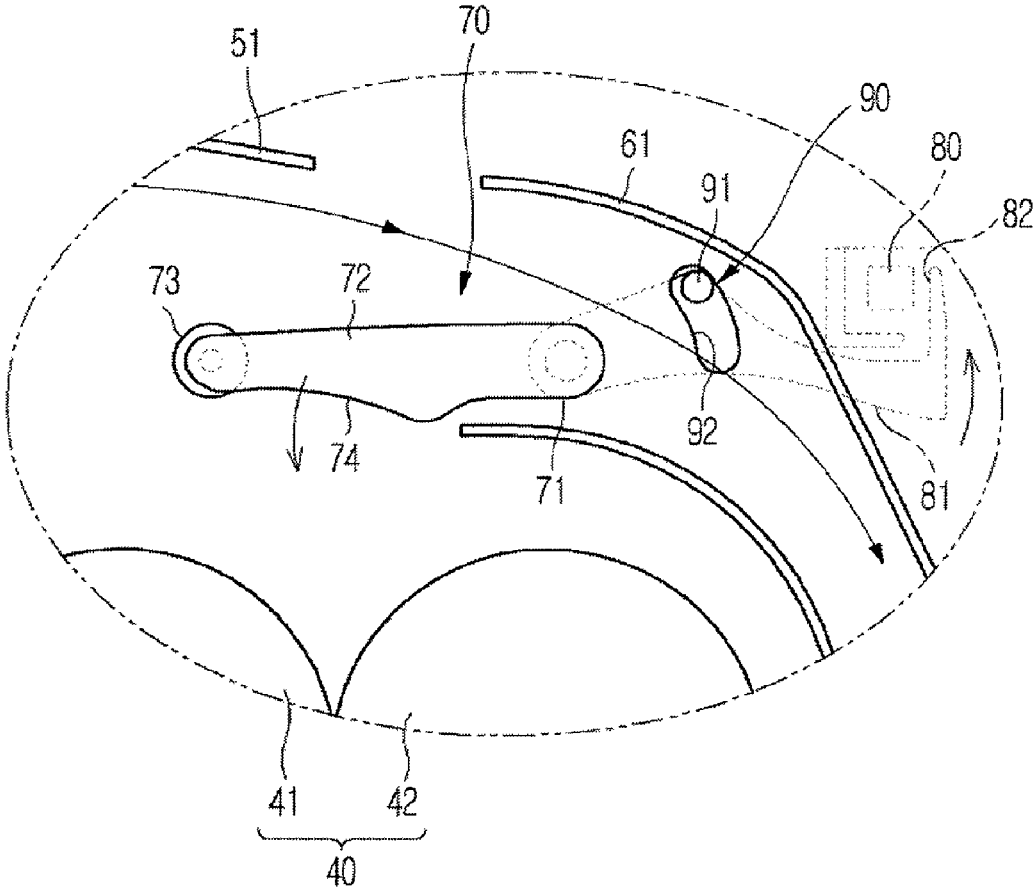
FIG. 3 is a detailed view of the "D" portion in FIG. 1, when the printing medium guide device is in a descending state.

As illustrated in FIG. 2, the printing medium guide portions 72 guide a front end of the printing medium, which ascends after passing through the fusing unit 40, toward the discharge path B. Because the printing medium guide portions 72 are lifted up by the ascending printing medium, the printing medium guide portions 72 smoothly guide the printing medium toward the discharge path B. Each of the printing medium guide portions 72 is provided with a curved portion 74 on a lower portion, by which the ascending printing medium can be guided toward the discharge path B while being bent. As illustrated in FIG. 3, after the printing medium is fed to the discharge path B, the printing medium guide portions 72 pivot to descend by a respective weight thereof.

The rollers 73 rotate by contacting the fed printing medium to minimize resistance to the printing medium feed. The printing medium rising from the fusing unit 40 initially lifts up the curved portions 74 of the printing medium guide portions 72, and is bent toward the rollers 73. Thereafter, the printing medium is fed to the discharge path B while contacting, for example, only the rotating rollers 73. Accordingly, the resistance, for example, caused by the printing medium guide portions 72 to the printing medium being feed is minimized.

The rollers 73 minimize a contact area of the printed surface of the printing medium and the printing medium guide portions 72 to minimize a phenomenon that the developer on the printing medium adheres and solidifies on the printing medium guide portions 72disrupt the printing medium being fed in a smooth manner. Accordingly, the developer is prevented from sticking to the printing medium guide portions 72 and interrupting the smooth feed of the printing medium. In an embodiment of the present inventive concept, even if some of the developer adheres on the rollers 73 during the feeding of the printing medium, rotation of the rollers 73 minimizes and/or prevents interruption of the feeding of the printing medium.

Figure 5:
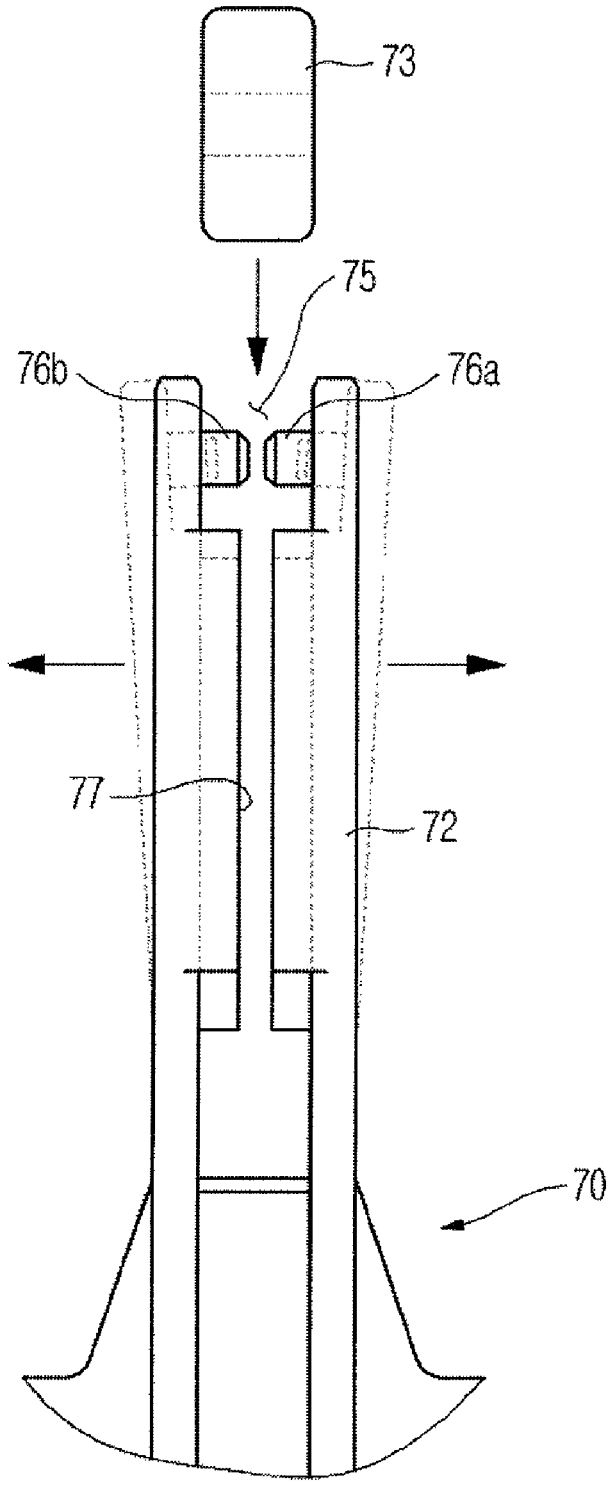
FIG. 5 is a view illustrating an embodiment of a printing medium guide portion and a roller mounting structure of the printing medium guide device depicted in FIG. 4.

As illustrated in FIG. 5, each of the printing medium guide portions 72 has a roller receiving portion 75 which is provided at an end of the respective printing medium guide portion 72 to mount the roller 73, and a pair of roller supporting shafts 76*a* and 76*b* which are provided on two opposite inner surfaces of the roller receiving portion 75. Each of the printing medium guide portions 72 may also have a cutting portion 77 which is formed lengthwise in a longitudinal direction so as to allow the roller 73 to be mounted on the roller supporting shafts 76*a* and 76*b*. The printing medium guide portion 72 is sectioned into left and right portions by the cutting portion 77, so that a gap between the roller supporting shafts 76*a* and 76*b* is widened to easily receive the roller 73 therein.

As illustrated in FIGS. 2 and 4, the image forming apparatus may also include a sensor 80 to sense an operation of the printing medium guide device 70, and a rotation limit device 90 to limit a rotational range of the printing medium guide device 70 to a predetermined range.

As illustrated in FIG. 4, the sensor 80 is mounted on an outer surface of the supporting plate 4, at a position deviated from a rotational center of the supporting shaft 71 of the printing medium guide device 70. An actuating portion 81, which extends toward the sensor 80, is coupled to the end portion of the supporting shaft 71 of the printing medium guide device 70. By sensing a movement of the actuating portion 81, the sensor 80 can sense a rotational state of the printing medium guide device 70. The actuating portion 81 extends in a direction opposite to the extending direction of the printing medium guide portions 72, and is provided with a hook portion 82 at an end to be sensed by the sensor 80. As illustrated in FIG. 2, when the printing medium guide portions 72 are lifted up and the actuating portion 81 descends, the hook portion 82 of the actuating portion 81 goes away from the sensor 80, and the sensor 80 detects the state in which the printing medium guide portions 72 are lifted up. As illustrated in FIG. 3, when the printing medium guide portions 72 descend by the respective weight thereof and the actuating portion 81 is lifted up, the hook portion 82 of the actuating portion 81 approaches the sensor 80, and the sensor 80 detects the state in which the printing medium guide portions 72 descend. The sensor 80 may be configured as an optical sensor or a microswitch.

By sensing the operational state of the printing medium guide device 70, the sensor 80 can detect whether the printing medium fed from the print path A toward the discharge path B has passed by the printing medium guide device 70. Such information detected by the sensor 80 can be used in controlling the printing medium feeding operation, e.g., controlling the operation of the discharge rollers 52 and 53. The sensor 80 can also detect a state in which the printing medium is caught in the fusing unit 40 and the printing medium guide portions 72 are kept in an ascending state.

As illustrated in FIGS. 2 and 4, the rotation limit device 90 includes a rotation limit protrusion 91 which is formed on the actuating portion 81 at a distance from the supporting shaft 71 and extends toward the supporting plate 4, and an arc-shaped rotation limit slot 92 which is provided at the supporting plate 4 and in which the rotation limit protrusion 91 is disposed. When the printing medium guide device 70 rotates, the rotation limit device 90 limits the rotational range of the printing medium guide device 70 such that the rotation limit protrusion 91 is caught in a lower end of the rotation limit slot 92 (refer to FIG. 2) or caught in an upper end of the rotation limit slot 92 (refer to FIG. 3).

Hereinafter, the operation of the printing medium guide device 70 will be described.

As illustrated in FIG. 2, the printing medium guide device 70 guides the printing medium, which ascends after passing through the fusing unit 40 in the print path A, to the discharge path B. As described above, because the printing medium guide portions 72 are lifted up by a rising force of the printing medium, the printing medium guide device 70 can guide the printing medium to the discharge path B. If the printing medium completely passes by the printing medium guide device 70 and is fed to the discharge path B, as illustrated in FIG. 3, the printing medium guide portions 72 descend to an original position by the respective weight thereof. Since the ascending or descending operation of the printing medium guide portions 72 is detected by the sensor 80, and a rotational range of the printing medium guide portions 72 is limited by the rotation limit device 90, the ascending position and the descending position of the printing medium guide portions 72 can be maintained accurately.

As illustrated in FIG. 1, in the duplex printing operation, the discharge rollers 52 and 53 rotate in the reverse direction so as to feed the printing medium in the discharge path B, of which one surface of the printing medium has been printed, to the reverse path C. At this time, as illustrated in FIG. 3, the printing medium guide portions 72 are kept in the descending state, so as to guide the printing medium to the reverse path C.

As apparent from the above description, the image forming apparatus according to various embodiments of the present general inventive concept can achieve the smooth printing medium feed by minimizing resistance to the printing medium feed, because the rollers of the printing medium guide device rotate by contacting the fed printing medium.

Further, since the printed surface of the printing medium comes into contact with the rollers, the contact area of the printing medium and the printing medium guide portions can be minimized. Accordingly, the present general inventive concept can minimize a phenomenon that the developer on the printing medium adheres to the printing medium guide portions and is solidified.

Although various embodiments of the present general inventive concept have been illustrated and described, it would be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a printing medium guide device to guide a printing medium in a print path to a discharge path and to guide the printing medium in the discharge path to a reverse path, wherein the printing medium guide device includes an arm, a supporting shaft about which the arm rotates, and rollers at an end of the arm opposite the supporting shaft to rotate by contacting the printing medium, the arm including a curved portion on one side to receive the printing medium at a location between the supporting shaft and the rollers and to guide the printing medium across the rollers toward the discharge path, wherein the printing medium guide device further comprises:

an actuating portion which extends from the supporting shaft so that a rotational position of the printing medium guide portion can be detected by a sensor;

a rotation limit protrusion provided on the actuating portion; and a rotation limit slot provided at a supporting plate supporting the supporting shaft and in which the rotation limit protrusion is disposed, and to limit a rotational range of the printing medium guide device to a predetermined range, wherein the supporting shaft is rotatably mounted near an outlet of the print path, and wherein the arm includes at least one printing medium guide portion which extends from the supporting shaft to rotate on the supporting shaft.

2. The image forming apparatus according to claim 1, wherein the printing medium guide portion includes a plurality of printing medium guide portions that are spaced apart from each other, the plurality of printing medium guide portions having ends which are directed toward the discharge path, and the rollers are mounted to the ends of the plurality of printing medium guide portions.

3. The image forming apparatus according to claim 2, wherein the printing medium guide device guides the printing medium to the discharge path by the printing medium guide portions being lifted up by the printing medium rising from the print path, and guides the printing medium in the discharge path to the reverse path by the printing medium guide portions descending by a respective weight thereof when the printing medium completely passes by the printing medium guide portions without moving the printing medium guide portions.

4. The image forming apparatus according to claim 2, wherein each of the plurality of printing medium guide portions comprises:

a roller receiving portion to receive a portion of a respective roller;

a pair of roller supporting shafts provided on two opposite inner surfaces of the roller receiving portion to support the respective roller; and an opening portion formed lengthwise in a longitudinal direction corresponding to a length axis of the shaft to allow the pair of roller support shafts to move apart from each other to mount the respective roller to the roller supporting shafts.

5. A printing medium guide device usable with an image forming apparatus having a discharge path and a reverse path, the printing medium guide device comprising:

a supporting shaft having a central axis and ends rotatably coupled to the image forming apparatus;

at least one guide portion having one or more arms extending from the shaft and having one or more rollers at the end of the one or more arms, and the at least one guide portion being movable between a discharge position to guide a printing medium to the discharge path and a reverse position to guide the printing medium to the reverse path;

an actuating portion which extends from the supporting shaft so that a rotational position of the printing medium guide portion can be detected by a sensor;

a rotation limit protrusion provided on the actuating portion; and a rotation limit slot provided at a supporting plate supporting the supporting shaft and in which the rotation limit protrusion is disposed, and to limit a rotational range of the printing medium guide device to a predetermined range, wherein the at least one guide portion moves to one of the discharge position and the reverse position by a contact force of the printing medium and moves to an other of the discharge position and the reverse position by a respective weight of the guide portion, such that the guide portion directs the printing medium in a direction from the support shaft towards the one or more rollers of the one or more arms when in the discharge position.

6. The device of claim 5, wherein the guide portion moves to the discharge position by the contact force of the printing medium and moves to the reverse position by the respective weight of the guide portion.

7. The device of claim 5, wherein the at least one guide portion comprises:

a curved portion to guide the printing medium toward the discharge path.

8. The device of claim 5, wherein a plurality of the guide portions are attached to the supporting shaft and arranged in a longitudinal direction thereof with a predetermined gap therebetween.

9. An image forming apparatus, comprising:

a print path to direct a printing medium to be printed thereon, a reverse path to direct the printing medium to reverse a side thereof to be printed thereon and a discharge path to direct the printing medium to be discharged from the image forming apparatus; and a printing medium guide device disposed at a junction of the print path, the reverse path and the discharge path, the printing medium guide device comprising:

a supporting shaft having a central axis and ends rotatably coupled to the image forming apparatus;

at least one guide portion having one or more arms extending from the shaft and having one or more rollers at an end of the one or more arms, and movable between a discharge position to guide the printing medium across the rollers to the discharge path and a reverse position to guide the printing medium to the reverse path;

an actuating portion which extends from the supporting shaft;

a rotation limit protrusion provided on the actuating portion; and a rotation limit slot provided at a supporting plate supporting the supporting shaft and in which the rotation limit protrusion is disposed, and to limit a rotational range of the printing medium guide device to a predetermined range, wherein the at least one guide portion moves to one of the discharge position and the reverse position by a contact force of the printing medium and moves to an other of the discharge position and the reverse position by a respective weight of the guide portion.

10. A printing medium guide device, comprising:

a shaft to rotate within a first hole of a supporting plate;

an actuating portion which extends from the shaft so that a rotational position of the printing medium guide device can be detected by a sensor;

at least one first arm connected to the shaft to rotate about the shaft and to guide a printing medium in a print path to at least one of a discharge path and a reverse path, the at least one first arm including at least one roller at an end of the at least one first arm;

at least one second arm which extends from the shaft so that a rotational position of the at least one first arm can be detected by a sensor;

at least one protrusion provided on the at least one second arm; and a second hole provided at the supporting plate an in which the at least one protrusion is disposed, and to limit a rotational range of the printing medium guide device to a predetermined range, wherein the shaft is rotatably mounted near an outlet of the print path, and wherein the arm includes at least one printing medium guide portion which extends from the shaft to rotate on the shaft.

* * * * *